United States Patent [19]

Poe

[11] Patent Number: 4,494,783

[45] Date of Patent: Jan. 22, 1985

[54] FLUSH TYPE ROTARY DRIVE FOR LATCHES

[75] Inventor: L. Richard Poe, Long Beach, Calif.

[73] Assignee: Hartwell Corporation, Placentia, Calif.

[21] Appl. No.: 356,379

[22] Filed: Mar. 9, 1982

Related U.S. Application Data

[60] Division of Ser. No. 159,594, Jun. 16, 1980, abandoned, which is a continuation of Ser. No. 20,506, Mar. 14, 1979, Pat. No. 4,265,474, which is a continuation of Ser. No. 856,504, Dec. 1, 1977, abandoned.

[51] Int. Cl.[3] ..... E05C 1/06

[52] U.S. Cl. ..... 292/155; 292/140; 70/438; 70/DIG. 59

[58] Field of Search ..... 292/143, 140, 57, 58, 292/60–62, 37, 155, 176; 70/432, 438, 441, DIG. 20, DIG. 59

[56] References Cited

U.S. PATENT DOCUMENTS

| | | | |
|---|---|---|---|
| 373,985 | 11/1887 | Johnson | 292/58 |
| 704,014 | 7/1902 | Espitallier | 292/58 |
| 1,152,443 | 9/1915 | Shaw | 70/438 |
| 1,639,661 | 8/1927 | Newcomb | 292/62 |
| 2,095,271 | 10/1937 | Swanstrom | 292/59 |
| 2,143,626 | 1/1939 | Jones | 292/58 X |
| 2,919,569 | 1/1960 | Davis | 70/97 |
| 2,969,667 | 1/1961 | Newcomer, Jr. et al. | 292/140 X |
| 3,254,517 | 6/1966 | Wheeler | 70/97 |
| 3,402,379 | 9/1968 | Amis, Jr. et al. | 292/252 X |
| 3,503,642 | 3/1970 | Poe | 70/432 |
| 3,907,348 | 9/1975 | Bates et al. | 292/241 X |
| 4,061,370 | 12/1977 | Hauber | 70/432 X |

FOREIGN PATENT DOCUMENTS

| | | | |
|---|---|---|---|
| 470419 | 6/1914 | France | 292/140 |
| 27593 | 4/1924 | France | 292/140 |

*Primary Examiner*—Gary L. Smith
*Assistant Examiner*—Thomas J. Dubnicka
*Attorney, Agent, or Firm*—Lyon & Lyon

[57] ABSTRACT

A flush type rotary drive means which is caused to move between a position flush with a surrounding surface and a protruding position as the latch is moved between its locked position and its unlatched position, the drive means, by reason of its protruding position, being readily visible to indicate the partially or completely unlocked condition of the latch; one embodiment being arranged to move a reciprocable latch; another embodiment being arranged to turn a rotary latch.

7 Claims, 9 Drawing Figures

FLUSH TYPE ROTARY DRIVE FOR LATCHES

This application is a divisional application of U.S. patent application Ser. No. 159,594, now abandoned, filed June 16, 1980; which is a continuation application of U.S. patent application Ser. No. 20,506 filed Mar. 14, 1979 which issued as Pat. No. 4,265,474 on May 5, 1981; which was a continuing application of U.S. patent application Ser. No. 856,504, filed Dec. 1, 1977, now abandoned.

BACKGROUND AND SUMMARY

Flush type rotationally driven latches are used extensively on aircraft; however, as the driving means remains in a flush condition whether or not the latch is in its locked or released position, observation of the exposed portions thereof gives no indication as to whether the latch is in its open or closed position.

The present invention is directed to a flush type rotary driven latch which overcomes this problem and is summarized in the following objects:

First, to provide a flush type latch utilizing a novelly arranged rotary drive means, wherein as the drive means turns to release the latch, the drive means moves from an initially flush position to a protruding, readily visible position.

Second, to provide a rotary drive means as indicated in the preceding object which may be adapted to various types of latches, such as reciprocable latches or rotatable latches.

DETAILED DESCRIPTION

Figure 1:
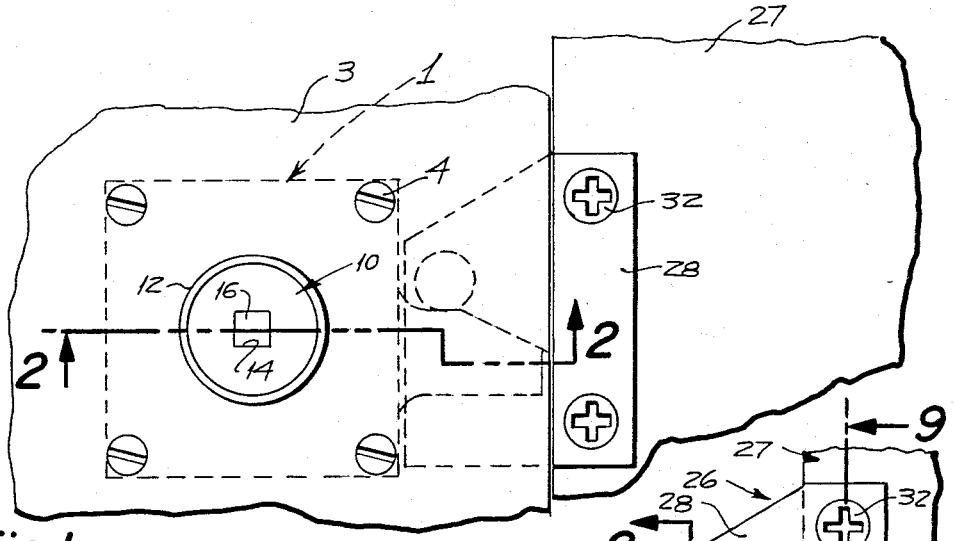
FIG. 1 is a fragmentary view indicating a portion of the surface of a removable or hinged panel and an adjacent portion of the structure in which the panel is mounted showing the flush type rotary drive for latches including both the latch and the keeper, concealed portions being indicated by broken lines.
Figure 2:
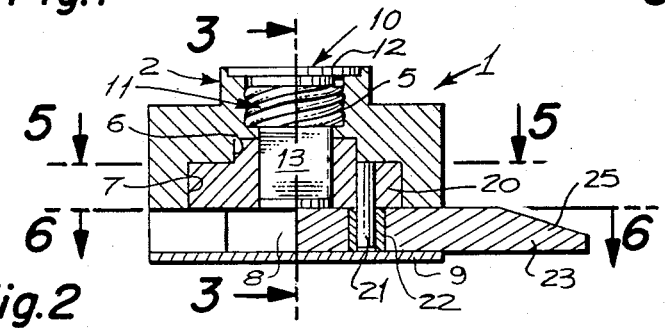
FIG. 2 is a sectional view of the latch and drive mechanism taken through 2—2 of FIG. 1 with the panel omitted.
Figure 7:
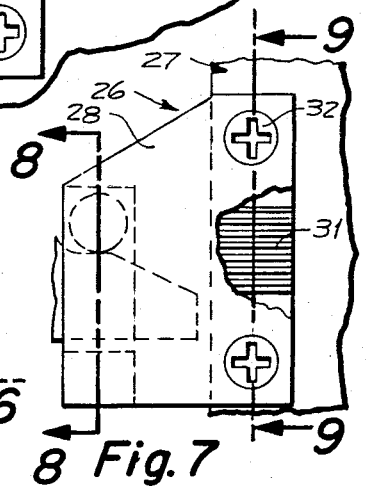
FIG. 7 is an elevational view of the keeper indicated by broken lines and also indicating by broken lines the relative position of the latch when in its locked condition.
Figure 3:
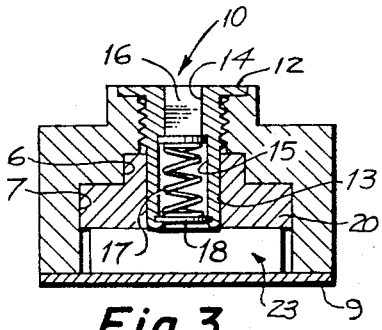
FIG. 3 is a sectional view of the latch and drive taken through 3—3 of FIG. 2 showing the drive in its retracted position.

Referring to FIGS. 1 through 6, the flush type rotary drive for latches herein illustrated includes a body 1 which may be in the form of a rectangular block provided at one side with a central outwardly extending boss 2. The body is mounted on an aircraft panel 3 which may be a hinged door or may be removable. The body 1 is attached to the panel by screws 4.

Centered in the boss 2 is a multiple screwthreaded bore 5. Inwardly therefrom there is provided a first enlarged bore 6 and a further enlarged bore 7 coaxial with the screwthreaded bore 5. Below the enlarged bore 7 is a cross slot 8 which receives a cover plate 9.

The body 1 receives a drive member 10 having a multiple screw portion 11 provided with a small flanged end 12. Below the screw portion, the drive member forms a drive shaft 13 of polygonal, preferably square, cross-section. Internally, the upper portion of the drive member is provided with a bore 14 of polygonal cross-section, preferably square. Below the bore 14 there is provided a circular counter bore 15.

Figure 4:
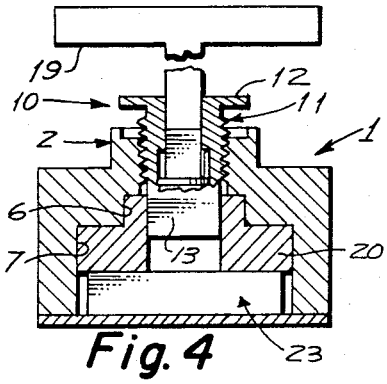
FIG. 4 is a similar sectional view showing the drive in its extended position.
Figure 8:
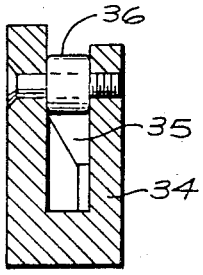
FIGS. 8 and 9 are sectional views taken through 8—8 and 9—9 respectively of FIG. 7.
Figure 5:
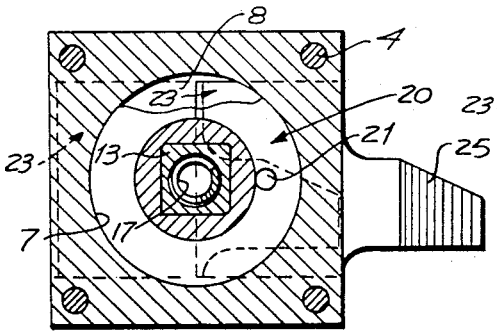
FIG. 5 is a sectional view taken through 5—5 of FIG. 2 showing the latch by solid lines in its extended position and by dotted lines in its retracted position.
Figure 6:
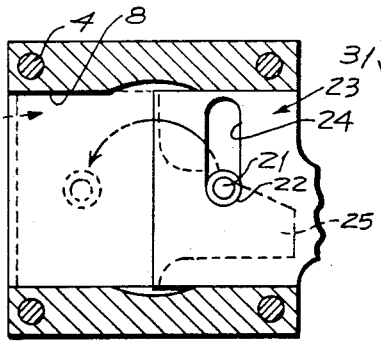
FIG. 6 is another sectional view taken through 6—6 of FIG. 2 showing the latch exposed and in its extended position by solid lines and in its retracted position by dotted lines.
Figure 9:
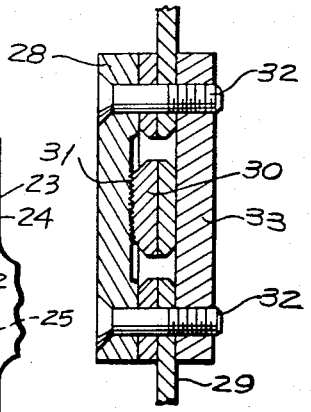
Figure 10:
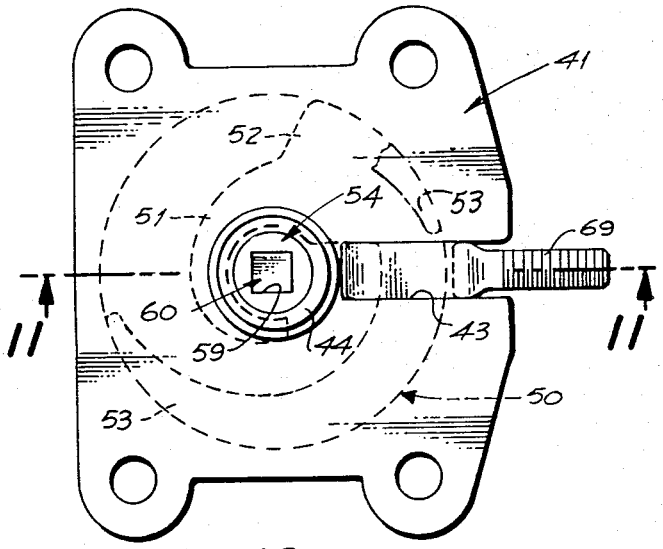
Figure 14:
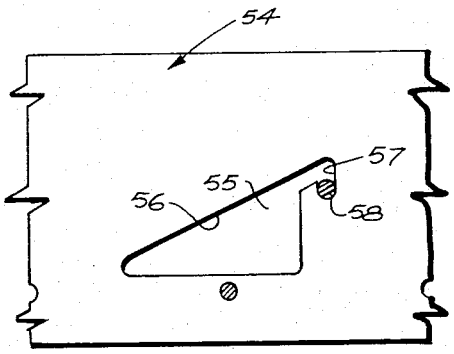
Figure 11:
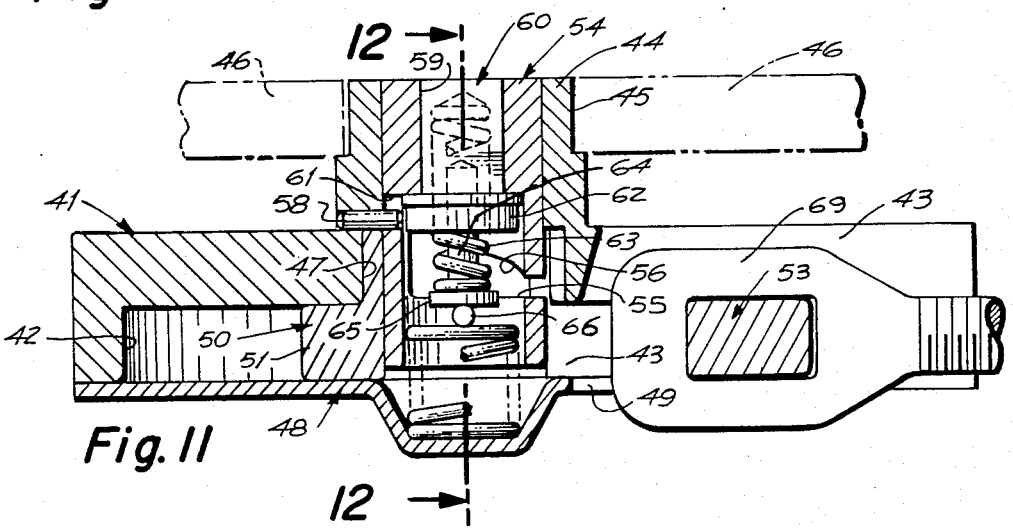
Figure 12:
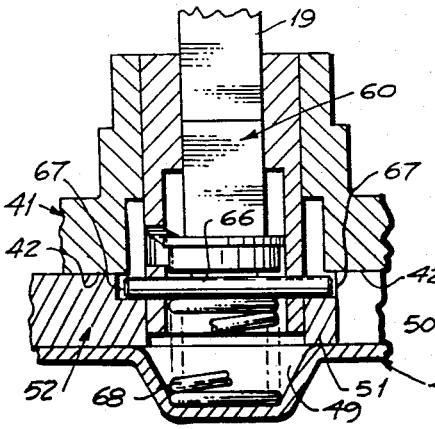
Figure 13:
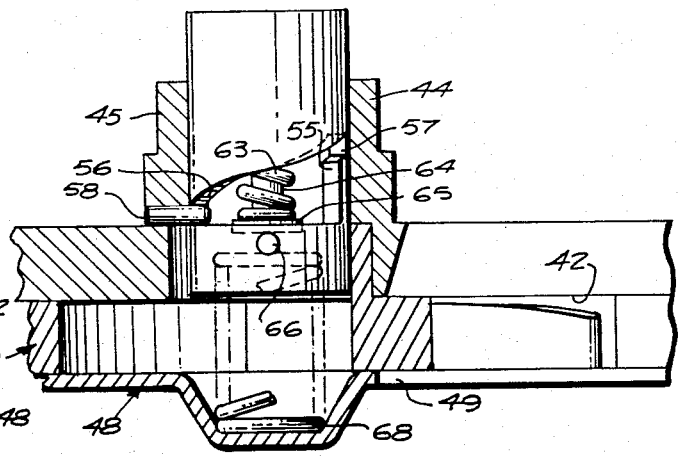

The polygonal bore 14 receives a correspondingly shaped slidable plug 16 flanged at its lower end. A spring 17 in the counter bore 15 bears between the flanged end of the plug 16 and a plate 18 at the lower end of the counter bore to maintain the exposed end of the plug 16 flush with the outer surface of the flanged end 12 of the drive member 10. A turning tool 19 is provided having a polygonal shape corresponding to the bore 14, as indicated in FIG. 4.

The counter bores 6 and 7 receive a drive disk 20, a cross bore of polygonal cross-section into which extends the drive shaft 13, the drive disk having a depending drive pin 21 provided with a roller 22 which projects into the cross slot 8. Slidably mounted in the cross slot 8 is a latch plate 23 having a transverse drive slot 24 which receives the pin 21 and roller 22 so that upon rotation of the drive member 10 and drive disk 20, the latch plate 23 may be reciprocated. Extending from the latch plate 23 is a latch member 25 movable between an extended and a retracted position.

Referring to FIG. 1 and FIGS. 7, 8 and 9, there is illustrated a keeper 26 carried by the wall surrounding the aircraft panel 3, such wall being indicated fragmentarily and indicated by 27. The keeper includes a mounting plate 28 secured to a supporting member 29 forming a part of the aircraft. Mounted on the supporting member 29 is an adjustment strip 30. The mounting plate 28 and the adjustment strip 30 are provided with mating serrations 31 so that the position of the mounting plate with respect to the support member may be adjusted. Screws 32 extend through the supporting member 29 into a plate 33 so that the mounting plate 28 may be secured in a predetermined position. The mounting plate 28 extends toward the body 1 into proximity therewith. At this end, the mounting plate supports a spaced guide bar 34 joined thereto by a connecting web 35 and a connecting roller 36 defining an opening for receiving the latch member 25.

Operation of the rotary drive and latch shown in FIGS. 1 through 9 is as follows:

The body 1 is so mounted in the aircraft panel 3 that the boss 2, the flanged end 12 of the drive member 10 and the outer end of the plug 16 are all flush with the outer surface of the panel, when the latch member 25 is received in the keeper 26. The latch member 25 is retracted upon insertion of a tool 19 in the drive bore 14 and the drive member 10 is rotated. Rotation of the drive member 10 causes the drive member to protrude as indicated in FIG. 4. As a half turn is adequate for retracting the latch member, the screw portion 11 is multiple pitched by a factor of 8 or 10. In its protruding condition, the drive member is readily visible so that the condition of the latch is readily ascertained.

Having fully described my invention it is to be understood that I am not to be limited to the details herein set forth, but that my invention is of the full scope of the appended claims.

I claim:

1. A flush mounted rotary drive latch for a panel having a perforation therethrough, comprising:

a. a latch body disposed at the inner side of the panel in alignment with the perforation;

b. a latch drive element mounted for partial rotation and a corresponding axial movement in said latch body and including a drive bore therein, said drive element being movable between a position flush with the panel and an extended position, said drive element, when in its extended position, being readily visible to indicate the unlatched condition of said latch element;

c. a latch element mounted to reciprocate in said latch body; and, d. a rotatable disk rotatably mounted in said latch body and disposed between said drive element and said latch element to rotate with said drive element, said rotatable disk including means between said rotatable disk and said latch element to transform rotational movement of said disk to reciprocating movement of said latch element between a latched position and an unlatched position when said drive element is moved from its flush position to its extended position.

2. A flush mounted rotary drive latch for a panel having a perforation therethrough, comprising:

a. a latch body disposed at the inner side of the panel in alignment with the perforation;

b. a latch drive element mounted for partial rotation and corresponding axial movement in said latch body, said drive element being movable between a position flush with the panel and an extended position by multiple screw threads and including a drive bore therein; and, c. a latch element mounted to reciprocate in said latch body and operatively connected to said drive element for movement between a latched position and an unlatched position when said drive element is moved from its flush position to its extended position, said drive element when in its extended position, being readily visible to indicate the unlatched condition of said latch element.

3. A flush mounted rotary drive latch for a panel having a latch opening and a keeper adjacent to the panel, comprising:

a. a body having a bore corresponding to the latch opening center and at least one counterbore;

b. a rotary, latch drive member received in said bore and including a drive bore therein;

c. means between said body and said drive member for effecting axial movement of said drive member corresponding to rotation of said drive member;

d. a latch means including a latch element mounted to reciprocate within said body and to engage with said keeper and means operatively connecting said latch drive member and said latch means for movement of the latch element into and out of engagement with the keeper; and, e. said drive member being movable by said means for effecting axial movement between a position flush with the panel when said latch element and keeper are interengaged and a visible protruding position when said latch element and keeper are disengaged.

4. A flush mounted rotary drive latch for a panel having a perforation therethrough, comprising, a. a latch body having a hole therethrough for alignment with the perforation;

b. a drive member aligned coaxially with said hole and including a drive bore therein;

c. means between said drive member and said body for effecting axial movement with respect to said body corresponding to rotation of said drive member;

d. a latch element slidable in said latch body;

e. an annular drive disk coaxial to said drive member, said drive disk constructed and arranged to transform rotational movement of said drive member to reciprocating movement of said latch element.

5. The flush mounted rotary drive latch of claim 4 wherein said means are multiple screw threads formed about said drive member.

6. The flush mounted rotary drive latch of claim 5 wherein said drive bore has a polygonal bore and said drive member has an internal chamber formed along the axis of said drive member, a polygonal plug fitted within said bore and extending to the upper face of said drive member, and a spring contained within said internal chamber to maintain the position of said plug.

7. A flush mounted rotary drive latch for a panel having a perforation therethrough, comprising;

a. a latch body having a bore therethrough for alignment with the perforation, the upper portion of said bore being circular with multiple screw threads formed thereon, the lower portion of said bore being enlarged to have an increased diameter;

b. a drive member including a first end, an upper portion adjacent to said first end and having multiple screw threads, and a lower portion of polygonal cross-section, said drive member being fitted into said bore in said body such that said first end may extend into the perforation and be flush with the panel, a polygonal bore along the longitudinal axis of said drive member, a polygonal plug spring-mounted within said drive member polygonal bore, said plug extending so as to be flush with the adjacent panel;

c. an annular drive disk with a polygonal bore as its center receiving said lower portion of said drive member, said drive disk being fitted about said drive member in said enlarged lower portion of said bore;

d. a latch element within said body beneath said drive disk, said latch element having a slot formed therein and being slidable in said body; and, e. a pin-roller radially offset from said bore on said annular drive disk and slidably connecting said slot in said latch element and said drive disk.

* * * * *